US005281178A

United States Patent [19]

Biscorner

[11] Patent Number: 5,281,178

[45] Date of Patent: Jan. 25, 1994

[54] ELECTRICAL CONNECTOR WITH FEATURE FOR INCREASED CONTACT AREA

[75] Inventor: Michael Biscorner, Belleville, Mich.

[73] Assignee: Yazaki Corporation, Tokyo, Japan

[21] Appl. No.: 966,533

[22] Filed: Oct. 26, 1992

[51] Int. Cl.[5] ..... H01R 13/187

[52] U.S. Cl. ..... 439/845; 439/850; 439/851

[58] Field of Search ..... 439/830, 833, 839, 849, 439/850, 851, 856, 861, 862, 857, 432–434, 387, 886, 887, 930, 519, 842, 843

[56] References Cited

U.S. PATENT DOCUMENTS

| | | | |
|---|---|---|---|
| 2,743,428 | 4/1956 | Martines | 439/851 |
| 2,763,848 | 9/1956 | Tuchel | 439/839 |
| 2,785,387 | 3/1957 | Batcheller | 439/849 |
| 3,209,311 | 9/1965 | Kukla | 439/851 |
| 3,404,370 | 10/1968 | Bryner et al. | 439/851 |
| 3,660,806 | 5/1972 | De Stephan | 339/256 SP |
| 4,764,133 | 8/1988 | Kaneko | 439/850 |

FOREIGN PATENT DOCUMENTS

| | | | |
|---|---|---|---|
| 1465464 | 3/1969 | Fed. Rep. of Germany | 439/850 |
| 62-135374 | 8/1987 | Japan . | |

*Primary Examiner*—David L. Pirlot
*Attorney, Agent, or Firm*—Krass & Young

[57] ABSTRACT

A conjugate electrical connector with improved contact conductivity having slots or grooves in one terminal and rounded protrusions on the opposite terminal. This contact feature provides for two lines of contact points per protrusion/slot pair where the protrusion touches the two edges of the slot whereas the closest prior art only provides one line of contact where a protrusion contacts a terminal without a slot. The amount of energy lost in heat dissipation due to contact resistance is reduced. Additional advantages include: the terminals will lock together with a mechanical confirmation, the terminal will seat in the same place each time it is connected, and movement between the terminals is less likely.

10 Claims, 2 Drawing Sheets

10
12
13
14
16
20
22
24
26
28
30
32
34
36
40
40a
42

ELECTRICAL CONNECTOR WITH FEATURE FOR INCREASED CONTACT AREA

FIELD OF THE INVENTION

This present invention relates to conjugate electrical connectors and, more particularly, to electrical connectors with features for increasing the positive contact area of a connector without increasing the overall size of the connector.

BACKGROUND OF THE INVENTION

Presently, conjugate electrical connectors come in varying shapes and sizes, but they all have primarily the same components and work in much the same way. It is not uncommon to have an application which requires a connection that can be quickly and easily connected or released without tools. A problem with using this kind of electrical connection is that, due to the build-up of corrosion and contaminants and to the limited area of contact between the terminals, some resistance is always present. The result is a wasteful loss of electrical energy as it is dissipated as heat.

One common variety of electrical connector is the conjugate electrical connector. The male terminal has a flat blade or tab for interface with the female terminal and includes means for permanently joining the tab to a conductor. Typically, the tab is joined to the conductor by crimping, soldering, welding, or some combination of the three.

The female terminal is dimensioned to encase the male terminal and, on three sides, resembles a rectangular box. The fourth side typically has a spring integrated therein to provide the force for frictional engagement between the two terminals and to prevent the terminals from becoming unintentionally disconnected.

One type of spring design used in female terminals is of the leaf spring variety. The spring is a separate piece of bowed metal crimped into place on the fourth side of the female connector, thus defining an aperture to accept the tab of the male connector. The spring presses against one flat side of the tab to force the second flat side of the tab against a contact surface defined by the side of the female terminal opposite the spring. Typically with this configuration, there are rounded protrusions on the contact surface of the female terminal for making positive contact with the tab. Since the protrusions define only line contacts with the tab, the spring force creates a great deal of pressure along the line contacts. When the tab is inserted into the female terminal, this pressure forces the corrosion and contaminants out from between the two contacting surfaces, thus making a line of positive contact.

Another type of spring design used in female terminals is formed from the same piece of material as the rest of the female terminal. The forth side of the terminal is split and the confronting end edges defined at the split are bent to provide two resilient downturned cantilevered fingers which, in conjunction with the three rectangular box sides, define an aperture to receive the male terminal tab with an interference fit. Due to the resiliency of the material, the fingers do not deform plastically when the tab is inserted into the female terminal aperture but, rather, a constant force is applied to the male tab by the end edges of the fingers. In this case, the lines of positive contact are defined between the end edges of the fingers and the confronting flat surface of the tab.

SUMMARY OF THE INVENTION

The invention is directed to an improved electrical connector which provides increased positive contact area in order to reduce the amount of energy dissipated as heat in the connector.

In the prior art, contact is made along a line of contact between the rounded protrusion on the first terminal and the confronting surface of the second terminal so that, for each protrusion, there is only one line of contact. According to the invention, one of the connectors defines an elongated slot having side edges and the other connector defines a protrusion sized and configured to fit into the slot with the connectors coupled to define a line contact with the slot at each side edge of the slot. This arrangement provides a line contact along each of the two opposite edges of the slot, thereby effectively doubling the number of lines of contact between terminals for each protrusion, and correspondingly reducing the amount of energy lost in the connection, without increasing the overall package size.

DETAILED DESCRIPTION OF THE INVENTION

Figures 1, 2, 3, 4, 6:
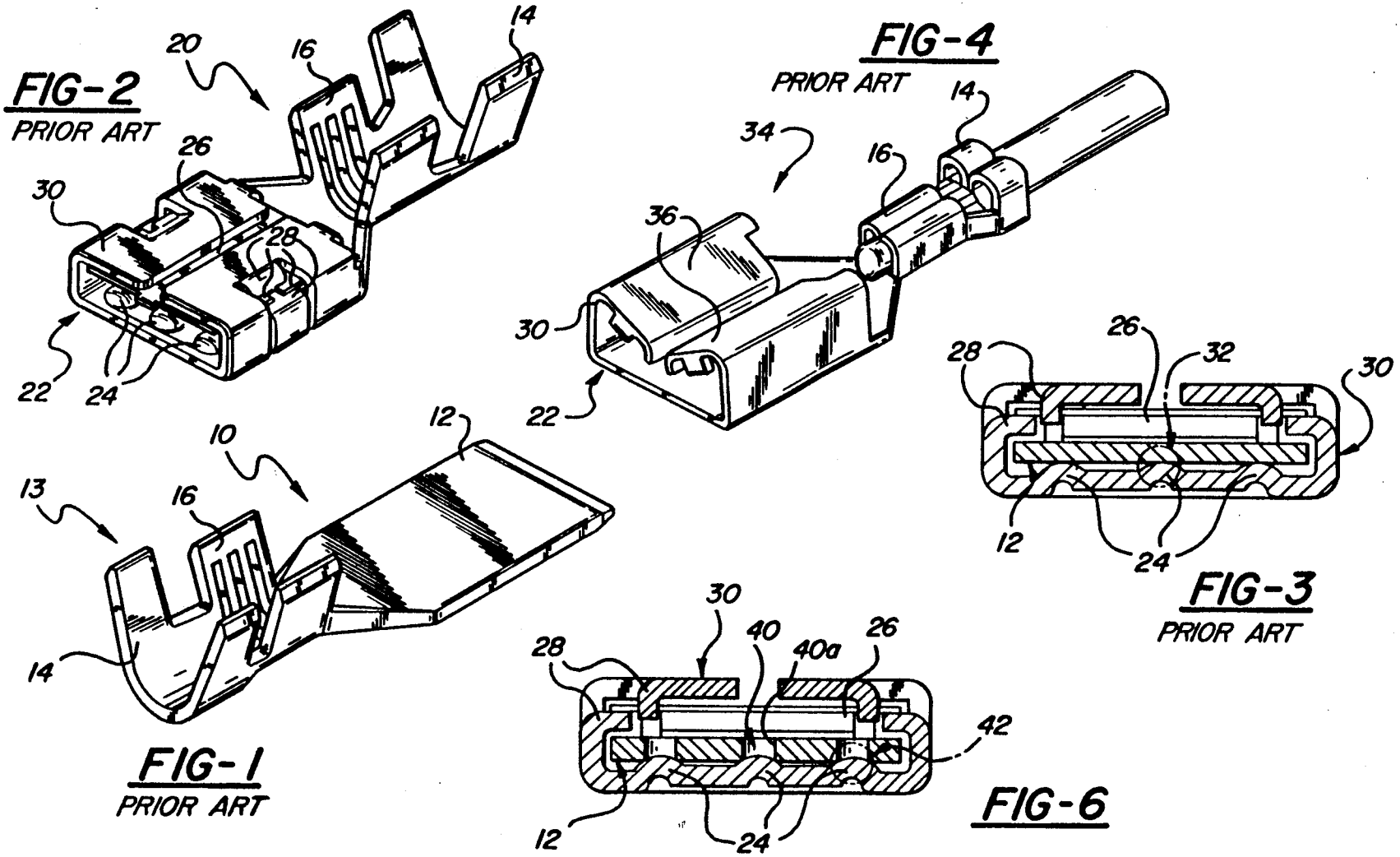
FIG-1 PRIOR ART
FIG-2 PRIOR ART
FIG-3 PRIOR ART
FIG-4 PRIOR ART
FIG. 1 is a perspective view of a typical prior art male terminal.
FIG. 2 is a perspective view of a typical prior art female terminal with a leaf spring arrangement.
FIG. 3 is a sectional view of a female terminal with a leaf spring arrangement connected to a male terminal.
FIG. 4 is a perspective view of a typical prior art female terminal with a cantilever finger arrangement.
FIG. 6 is a sectional view of the preferred embodiment of the male terminal mated with a female terminal and showing the improved contact feature.

FIGS. 1 through 4 depict two variations of conjugate electrical connectors that are well known in the art. First, a male terminal, generally indicated at 10, comprises a mating tab portion 12 and a crimping portion 13. Portion 12 has several functions. One function is to provide the surface which will be frictionally engaged by a female terminal. This friction in turn provides one way that the two terminals will remain engaged under loads and during vibration. Locking features may also be integrated into the tab 12 to insure that the terminals will not become disconnected under any circumstances. The tip of the tab 12 is typically tapered to reduce the force required to insert the tab into a female terminal.

Crimping portion 13 serves two functions: to provide a strain relief for a conductor attached to the terminal 10 and to provide a reliable electrical connection between the conductor and the terminal 10. Crimping portion 13 includes a pair of strain relief tabs 14 and a pair of wire crimp tabs 16. Strain relief tabs 14, positioned at the end of the terminal 10, are bent over to securely engage the insulation near the end of the conductor. Wire crimp tabs 16, positioned between the strain relief tabs 14 and the tab portion 12, are bent over to make positive contact with the end of the conductor, which has been stripped of its insulation. A crimped conductor is shown in FIG. 4.

FIG. 2 shows a leaf-spring type female conjugate terminal 20 that is well known in the art. Female terminal 20 defines an aperture 22 that will accept the mating tab 12 of the male terminal 10. A rectangular box forms the tab receiving portion 30 of the female terminal 20. Aperture 22 is defined by the front end of the tab receiving portion 30 which is open to allow access to the interior of the tab receiving portion. The width of aperture 22 is dimensioned to allow a clearance fit with the mating tab 12 of the corresponding male terminal 10. The height of the aperture 22 is dependant on two features—rounded protrusions 24 on one surface of the inside of the tab receiving portion 30 and a leaf spring 26 on the inside of the opposite surface. The rounded protrusions 24 typically extend along the insertion axis the greater part of the distance from the aperture 22 to the rear of the tab receiving portion 30. There are usually at least two rounded protrusions 24 side by side to prevent the mating tab 12 from rocking. However, the rounded protrusions 24 may extend for any length in any direction and in any quantity within the physical bounds of the tab receiving portion 30. Leaf spring 26 is held in place by interlocking tabs 28. When the mating tab 12 of the male terminal 10 is inserted into the aperture 22 of the female terminal 20, the spring 26 forces the mating tab 12 against the rounded protrusions 24, producing positive contact between the rounded protrusions 24 and the mating terminal 12. The points of positive contact define one line of contact 32 at the crest of each rounded protrusion 24.

A cross section of the male terminal of FIG. 1 mated to the female terminal of FIG. 2 is depicted in FIG. 3. The spring 26, secured to the top of tab receiving portion 30 of the female terminal 20 by interlocking tabs 28, exerts force upon the mating tab 12 of the male terminal 10, thereby frictionally engaging the rounded protrusions 24 and the mating tab 12. Because the lines of contact 32 have so little area, the pressure at those points is great.

A second commonly known female configuration is shown in FIG. 4. Rather than employing a separate leaf spring, this female terminal 34 has depending cantilever fingers 36 integrated into the top surface of the tab receiving portion 30 which serve two purposes. Firstly, the material of the tab receiving portion 30 and depending fingers 36 is resilient, so when the mating tab 12 is inserted into the aperture 22 and the fingers 36 are deflected, a force is transmitted therethrough, holding the two terminals in a mated arrangement. Secondly, the tips of the depending fingers 36 serve to make positive contact with the mating tab 12 of the male terminal. Since the ends of the depending fingers 36 define only small line contact surface areas with the mating tab 12, a significant amount of contact pressure is produced, and corrosion and contaminants on the surfaces of the terminals can be penetrated.

Figure 5:
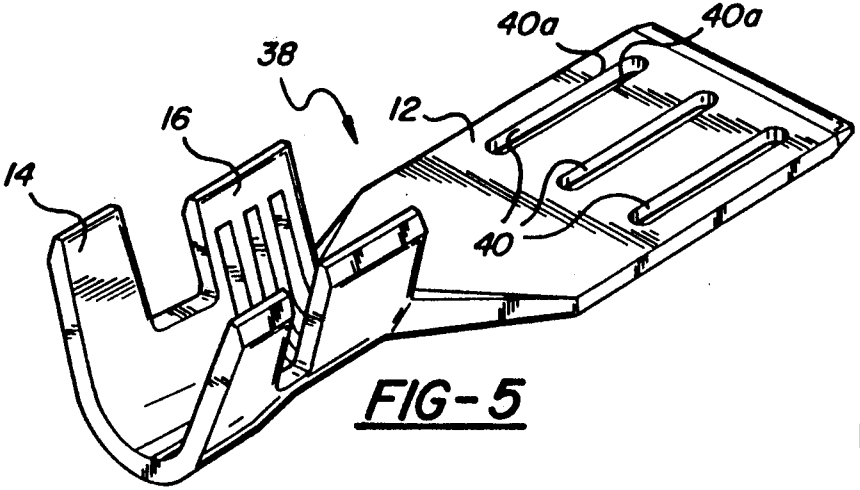
FIG. 5 is a perspective view of a preferred embodiment of the male terminal with slots in the tab portion.

The connector of the invention is shown in its preferred embodiment in FIG. 5. The male terminal 38 of the invention connector corresponds generally to the prior art terminal 10 of FIG. 1 except that a series of grooves or slots 40 have been cut into the tab portion 12. Each slot 40 includes a pair of parallel side edges **40*a* defining corner edges 40*b*. The slots are positioned and dimensioned to correlate to the rounded protrusions 24 on the bottom of the tab receiving portion 30 of a prior art female terminal 20 when the terminals are mated. It is critical that the slots 40 be longer than the corresponding protrusions 24 and that the width of the slots 40 be narrower than the width of the protrusions 24 at the base of the protrusions 24. In the preferred embodiment, the slots 40 and protrusions 24 are positioned with their long dimensions parallel to the direction that the mating tab 12 of the male terminal 38 is inserted into the aperture 22 of the tab receiving portion 30 of the female terminal 20. This particular orientation facilitates a wiping action between the protrusions and the slots during the act of insertion of the mating tab 12 into the aperture 22 of the tab receiving portion 30**, further improving the electrical conductivity at contact points.

FIG. 6 shows the cross-section of the preferred embodiment of the male and female terminals mated together. The preferred embodiment of the female terminal is the same as the prior art female terminal as depicted in FIG. 2. The contact feature 42 of the invention is between the side edges **40*a* of the slots 40 in the mating tab 12 and the rounded protrusions 24 on the female terminal 20. Specifically, each protrusion in cross section defines first and second longitudinally extending and angularly related surface areas 24*a*, 24*b* on opposite sides of the crest 24*c* of the protrusion. With the connectors coupled, the first and second surface areas 24*a* and 24*b* respectively engage first and second corner edges 40*b* of the slot so that for each rounded protrusion, two lines of contact are made, one along each of the two corner edges 40*b*** of each slot, compared to only one line of contact for each protrusion in the prior art. This arrangement effectively doubles the contact area between the terminals, and thus reduces the electrical resistance between the terminals and the energy lost to heat dissipation. This arrangement also allows the terminals to lock together with a mechanical confirmation; insures that the male terminal will seat in the precise same position in the female terminal each time the terminals are connected; and significantly limits movement between the connected terminals.

There are innumerable configurations that the slots 40 and protrusions 24 can take with respect to size, relative placement, and orientation. For example, there may be a series of protrusions disposed to engage only one slot. Additionally, the slots may not penetrate the material of the terminal completely, but rather may comprise only indentations in the surface of the material.

Figure 7:
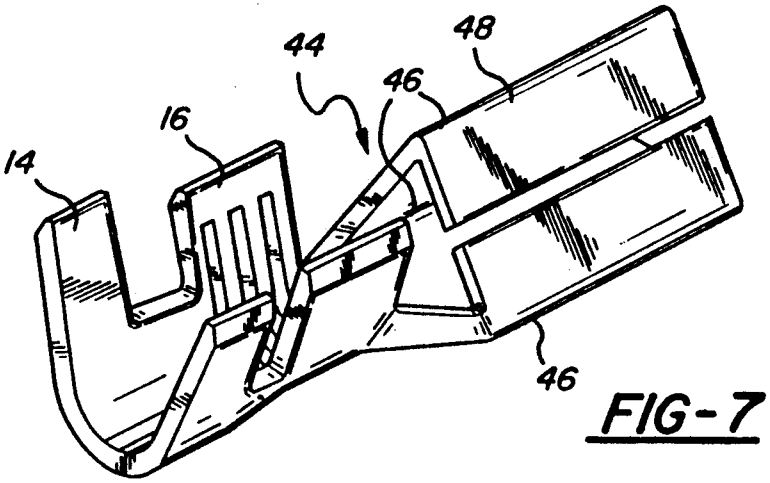
FIG. 7 is a perspective view of an alternative embodiment of the invention wherein the male terminal defines rounded protrusions on three sides of the terminal.

A further embodiment of the invention is shown in FIG. 7 wherein the insertion or mating part 48 of the male terminal 44 is not a flat tab member but rather has a triangular configuration with rounded corners 46 defining protrusions. The crimping hardware 14,16 again is commonly known in the art.

Figure 8:
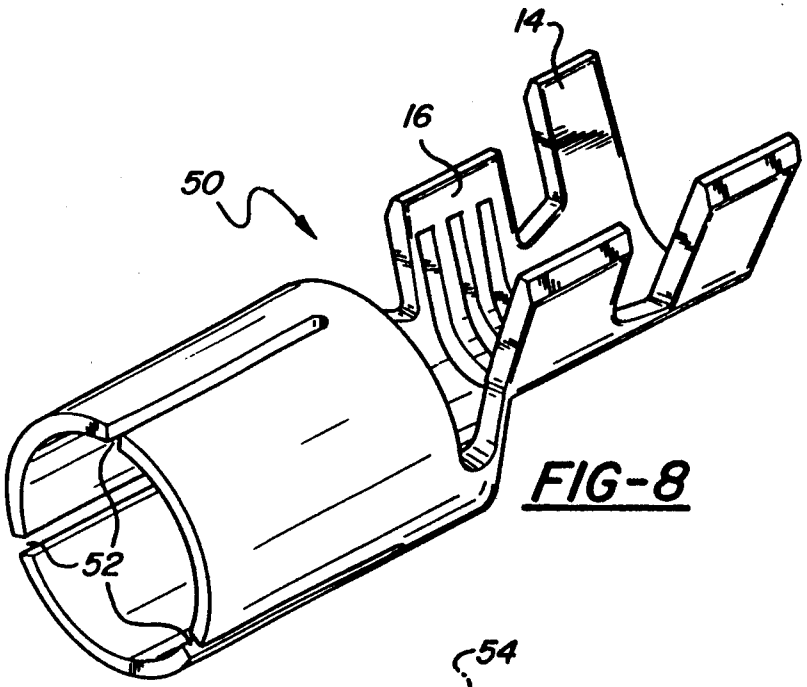
FIG. 8 is a perspective view of an alternative embodiment of the invention wherein slots are located in a cylindrical female terminal designed to mate with the three sided male terminal of FIG. 8.

The female terminal for connection to the male terminal of FIG. 7 is shown in FIG. 8. This alternative embodiment of the female terminal, generally indicated at 50, has a uniform tubular circular cross-section with slots 52 running in the direction of insertion and appropriately circumferentially spaced to mate respectively with the rounded corners or protrusions 46 of the male terminal.

Figure 9:
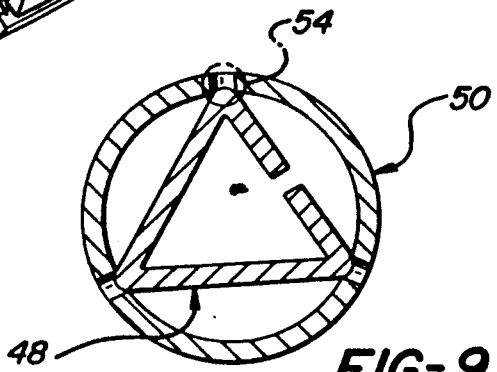
FIG. 9 is a sectional view of the male and female terminals of the alternative embodiment of the invention coupled together, showing the contact feature of the invention.

The contact features of this alternative embodiment are shown in FIG. 9. Each of the three rounded corners or protrusions 46 of the mating portion 48 of the male terminal 44 contact a corresponding slot in two places at the edges of the slot to define two lines of contact. Specifically, each protrusion 46 in cross section defines first and second longitudinally extending and angularly related surface areas 46*a*,46*b* on opposite sides of the crest 46*c* of the protrusion. With the connectors coupled, the first and second surface areas 46*a* and 46*b* respectively engage first and second corner edges 52*a* of the slot 52 so that for each rounded protrusion, two lines of contact are made, one along each of the two corner edges 52*a* of each slot. This has the same effect as the interaction between the slots 40 and rounded protrusions 24 in the preferred embodiment.

The connector of the invention will be seen to provide may important advantages. Specifically, the amount of energy lost in heat dissipation in the connector due to contact resistance is reduced; the terminals are locked together with a mechanical confirmation; the male terminal seats in precisely the same position within the female terminal each time the connectors are associated; and movement between the connected terminals is significantly reduced. Further, testing and prototype production experience with the invention connector has indicated that, as compared to prior art connectors, there is less variation in resistance, terminal to terminal, in a production environment.

Whereas preferred embodiments of the invention have been illustrated and described in detail, it will be apparent that various changes may be made in the disclosed embodiments without departing from the scope or spirit of the invention.

What is claimed is:

1. A pair of conjugate electrical connectors adapted to be matingly coupled to provide an electrical flow path through the connectors characterized in that one of the connectors defines an elongated slot having parallel first and second longitudinally extending corner edges and the other connector defines a protrusion sized and configured to fit into the slot with the connectors coupled, said protrusion having a crest and defining parallel first and second angularly related longitudinally extending surface areas on opposite sides of the crest, said first and second surface areas respectively engaging said first and second corner edges to define a line contact with the slot at each corner edge of the slot.

2. A pair of connectors according to claim 1 wherein said one connector includes a flat tab portion, said slot is defined in said tab portion, the other connector defines a receptacle for receipt of said tab portion, and said protrusion is defined on said other connector within said receptacle.

3. An electrical connector for releasably bringing two current carriers into electrical communication with each other via a mechanical interface comprising:

a first terminal element with an elongated slot having parallel longitudinally extending corner edges;

a second terminal element with a rounded protrusion substantially mirroring the shape and size of the slot except that the protrusion is wider at its base than the width of the slot, said protrusion having a crest and defining parallel first and second angularly related longitudinally extending surface areas on opposite sides of the crest; and means for releasably forcing the first and second terminal elements together such that the protrusion seats partially in the slot with the first and second surface areas of the protrusion respectively engaging said first and second corner edges of the slot whereby to establish line contact between the protrusion and each of the opposite parallel corner edges of the slot.

4. In a conjugate electrical connector of the type including a male terminal element adapted to terminate a first current carrier and a female terminal element adapted to terminate a second current carrier, the first and second terminal elements defining a common insertion axis and being conjugally associable to establish an electrical connection between the first and second current carriers, the improvement wherein:

an arched protrusion is formed along the insertion axis of one of the terminal elements for creating frictional engagement to establish electrical communication between the first and second terminal elements when conjugally joined, said protrusion having a crest and defining parallel first and second angularly related longitudinally extending surface areas on opposite sides of the crest; and a groove is formed in the other of the terminal elements lying along the insertion axis and adapted to partially receive the protrusion therein, said groove defining parallel first and second longitudinally extending corner edges, said first and second protrusion surface areas respectively engaging said first and second corner edges when the connectors are coupled;

whereby when the terminals are associated electrical communication is established by frictional engagement along two distinct lines of contact between the opposite corner edges of the groove on one terminal element and the protrusion on the other terminal element.

5. A connector according to claim 4 wherein the dimension of the groove lateral to the insertion axis is less than the lateral dimension at the base of the protrusion.

6. A connector according to claim 4 wherein a plurality of grooves are provided on said other element for respective receipt of a plurality of protrusions on said one element.

7. A connector according to claim 4 wherein the groove extends completely through the terminal element.

8. A pair of conjugate electrical connectors adapted to be matingly coupled to provide an electrical flow path through the connectors characterized in that one of the connectors defines an elongated slot having side edges and the other connector defines a protrusion sized and configured to fit into the slot with the connectors coupled to define a line contact with the slot at each side edge of the slot, said one connector being tubular and defining a plurality of slots at circumferentially spaced locations about the periphery of the connector and said other connectors being sized to be inserted into said one connector and defining a plurality of protrusions for respective coaction with said slots.

9. A pair of connectors according to claim 8 wherein said other connector is triangular and defines a protrusion at each corner of the triangle.

10. In a conjugate electrical connector of the type including a male terminal element adapted to terminate a first current carrier and a female terminal element adapted to terminate a second current carrier, the first and second terminal elements defining a common insertion axis and being conjugally associable to establish an electrical connection between the first and second current carriers, the improvement wherein:

an arched protrusion is formed along the insertion axis of one of the terminal elements for creating frictional engagement to establish electrical communication between the first and second terminal element when conjugally joined; and a groove is formed in the other of the terminal elements lying along the insertion axis and adapted to partially receive the protrusion therein;

whereby when the terminals are associated electrical communication is established by frictional engagement along two distinct lines of contact between the opposite side edges of the groove on one terminal element and the protrusion on the other terminal element;

the dimension of the groove lateral to the insertion axis being less than the lateral dimension at the base of the protrusion; and the groove being located in the male terminal element and the protrusion being located in the female terminal element.

* * * * *